US007237284B2

(12) United States Patent
Hensley et al.

(10) Patent No.: US 7,237,284 B2
(45) **Date of Patent: *Jul. 3, 2007**

(54) BED WITH ARTICULATED BARRIER ELEMENTS

(75) Inventors: David W. Hensley, Milan, IN (US); Sébastien Gemeline, Lorient (FR); Yann Dollo, Belz (FR)

(73) Assignee: Hill-Rom S.A.S., Pluvigner (FR)

( * ) Notice: Subject to any disclaimer, the term of this patent is extended or adjusted under 35 U.S.C. 154(b) by 0 days.

This patent is subject to a terminal disclaimer.

(21) Appl. No.: 11/093,253

(22) Filed: Mar. 29, 2005

(65) Prior Publication Data

US 2005/0166321 A1 Aug. 4, 2005

Related U.S. Application Data

(63) Continuation of application No. 10/399,465, filed as application No. PCT/FR01/03224 on Oct. 18, 2001, now Pat. No. 6,874,179.

(30) Foreign Application Priority Data

Oct. 19, 2000 (FR) ..... 00 13366

(51) Int. Cl.
*A47C 21/08* (2006.01)

(52) U.S. Cl. ..... 5/425; 5/428; 5/430

(58) Field of Classification Search ..... 5/425–430, 5/512, 662, 624

See application file for complete search history.

(56) References Cited

U.S. PATENT DOCUMENTS

| | | | |
|---|---|---|---|
| 421,656 | A | 2/1890 | Blanken |
| 993,119 | A | 5/1911 | Stannard |
| 2,136,088 | A | 11/1938 | Stevens, Sr. |
| 2,644,173 | A | 7/1953 | James |
| 2,710,976 | A | 6/1955 | Martensen |
| 2,951,252 | A | 9/1960 | Roche |
| 2,979,738 | A | 4/1961 | Goldberg |
| 3,018,492 | A | 1/1962 | Rosen |
| 3,148,387 | A | 9/1964 | Sarnie, Jr. et al. |
| 3,195,151 | A | 7/1965 | Boyer |
| 3,220,022 | A | 11/1965 | Nelson |
| 3,262,133 | A | 7/1966 | Beitzel |
| 3,321,779 | A | 5/1967 | Kaufman et al. |
| 3,384,147 | A | 5/1968 | Ferris |
| 3,614,795 | A | 10/1971 | Agnew |
| 3,619,824 | A | 11/1971 | Doyle |
| 3,742,530 | A | 7/1973 | Clark |
| 3,877,090 | A | 4/1975 | Schutz |
| 4,183,015 | A | 1/1980 | Drew et al. |
| 4,214,326 | A | 7/1980 | Spann |

(Continued)

FOREIGN PATENT DOCUMENTS

| | | |
|---|---|---|
| FR | 2 680 955 | 3/1993 |
| GB | 2 284 147 | 5/1995 |

OTHER PUBLICATIONS

Catalog: "A Hill-Rom Solution: Med-Surg Bed Accessories," Hill-Rom, 1997.

*Primary Examiner*—Michael Trettel
(74) *Attorney, Agent, or Firm*—Barnes & Thornburg LLP

(57) ABSTRACT

The present invention relates to a bed, in particular a hospital bed, fitted with a plurality of adjacent individual barrier elements along at least one of its longitudinal sides, the barrier elements extending vertically and each occupying a fraction of the length of the bed.

24 Claims, 12 Drawing Sheets

U.S. PATENT DOCUMENTS 4,215,446 A 8/1980 Mahoney
4,232,415 A 11/1980 Webber
4,370,765 A 2/1983 Webber
4,439,880 A 4/1984 Koncelik et al.
D276,112 S 10/1984 Ferrell et al.
4,607,402 A 8/1986 Pollard
4,653,129 A 3/1987 Kuck et al.
4,654,903 A 4/1987 Chubb et al.
4,670,923 A 6/1987 Gabriel et al.
4,672,698 A 6/1987 Sands
4,676,687 A 6/1987 Koffler
4,704,750 A 11/1987 Wheelock
4,710,049 A 12/1987 Chang
4,710,992 A 12/1987 Falwell et al.
4,745,647 A 5/1988 Goodwin
4,767,419 A 8/1988 Fattore
4,768,249 A 9/1988 Goodwin
4,783,864 A 11/1988 Turner
4,800,600 A 1/1989 Baum
4,827,545 A 5/1989 Arp
4,872,228 A 10/1989 Bishop
4,873,734 A 10/1989 Pollard
5,010,611 A 4/1991 Mallett
5,035,014 A 7/1991 Blanchard
5,044,025 A 9/1991 Hunsinger et al.
5,077,843 A 1/1992 Dale et al.
5,083,332 A 1/1992 Foster et al.
5,083,334 A 1/1992 Huck et al.
5,084,925 A 2/1992 Cook
5,097,550 A 3/1992 Marra, Jr.
5,129,117 A 7/1992 Celestina et al.
5,175,897 A 1/1993 Marra, Jr.
5,179,774 A 1/1993 Massie
5,191,663 A 3/1993 Holder et al.
5,216,768 A 6/1993 Bodine et al.
5,381,571 A * 1/1995 Gabhart ..... 5/430
5,410,765 A 5/1995 Dicken
5,421,046 A 6/1995 Vande Streek
5,450,641 A 9/1995 Montgomery
5,455,973 A 10/1995 Brumfield et al.
5,481,772 A 1/1996 Glynn et al.
5,485,699 A 1/1996 Gabhart
5,524,306 A 6/1996 Georeg
5,557,817 A 9/1996 Haddock
5,577,277 A 11/1996 Sundberg et al.
5,642,545 A 7/1997 Howard
5,671,490 A 9/1997 Wu
5,689,839 A 11/1997 Laganiere et al.
5,732,423 A 3/1998 Weismiller et al.
5,749,112 A 5/1998 Metzler
5,761,756 A 6/1998 Nowak et al.
5,771,506 A 6/1998 Joiner
5,781,945 A 7/1998 Scherer et al.
5,802,636 A 9/1998 Corbin et al.
5,864,900 A 2/1999 Landau
5,926,873 A 7/1999 Fountain
6,038,721 A * 3/2000 Gordon ..... 5/663
6,058,531 A 5/2000 Carroll
6,401,277 B1 * 6/2002 Savage et al. ..... 5/430
6,721,975 B1 * 4/2004 Lemire ..... 5/430
6,874,179 B2 * 4/2005 Hensley et al. ..... 5/425

* cited by examiner 830
83
831
80
X
81
8
811
810
82
XVI
XV
X'
812
5'
5
XX'
801
802
803
804
805

5
5'
9
90
91
92
93
94
900
901
902
903
904
910
911
912
913
914
915
920
921
922
930
931
X
X'
XX'
XX
XIX

BED WITH ARTICULATED BARRIER ELEMENTS

This application is a continuation of U.S. patent application Ser. No. 10/399,465, filed Apr. 18, 2003, now U.S. Pat. No. 6,874,179, which is a national phase application of PCT/FR01/03224, filed Oct. 18, 2001, which claims priority to French Application Ser. No. FR 00 013366, filed Oct. 19, 2000, the disclosures of which are expressly incorporated herein by reference.

BACKGROUND AND SUMMARY OF THE INVENTION

The present invention relates to a bed, in particular a hospital bed, which is fitted along at least one of its two longitudinal sides with a plurality of adjacent individual barrier elements, each extending over a fraction of the length of the bed.

The term "hospital bed" is used to mean any bed fitted with optionally power driven means that enable assistance to be given to a person lying in the bed.

At present, nearly all such beds are fitted with at least one retractable longitudinal barrier having the function of preventing the patient from falling out of bed while unattended.

Such barriers have the characteristic of extending along the entire length of the bed in the raised position and in the lowered position, such that they are of no help to a person seeking to move from a prone position to a sitting position. Such a person often seeks a support point for making the movement easier. That type of barrier, which can be referred to as "full", provides no help under such circumstances.

Another drawback of such barriers is psychological in nature, based on the fact that they give the bed a "cage" appearance which is no help in making a patient feel at ease.

Those problems have been solved in part by proposing to fit beds with barriers that are independent of one another, each extending over a fraction of the length of the bed. In order to distinguish such barriers from full barriers, they are referred to below as barrier "elements".

Thus, two distinct barrier elements extend along either side of the bed, with the gap between them being large enough to allow the patient to take up a sitting position. An example of that state of the art is shown in document U.S. Pat. No. 5,216,768.

Each element may be secured to the bed plane that receives the mattress, even when the bed plane comprises a plurality of portions, at least one of which can be moved into a position other than horizontal.

When the patient is in the prone position and the elements are in the raised position, the elements prevent the patient from falling out of bed unless the patient manages to position the torso between the two elements.

Safety regulations require the spacing between the elements to be less than 60 millimeters (mm) or greater than 235 mm, whatever their relative position. This means, for example, that when an element is secured to a portion of the bed plane, said portion being in a raised position, then the spacing between said elements and the second element must still comply with the values specified above.

In spite of that, there remains some risk of accident, particularly when a patient in a sitting position between the elements falls. The patient's torso can then become wedged between the elements.

In addition, each of the two barrier elements requires its own mechanism for fixing to the bed, together with a mechanism for retracting it beneath the bed plane. It will readily be understood that this increase in mechanical parts increases the cost price of the bed and makes the structure and the operation of the bed more complicated.

An object of the present invention is to mitigate those drawbacks.

More precisely, a particular object is to provide a bed having individual barrier elements, the bed presenting the advantages associated with such elements and also with traditional full barriers, without presenting the drawbacks.

In other words, the object of the invention is to provide a bed whose barrier system can be used equally well as an individual barrier element and as a full barrier.

The invention seeks to provide a bed which can be used without risk of accident, and in particular without risk of the fingers or the limbs becoming pinched or trapped between moving parts.

In conventional manner, this bed, in particular a hospital bed, is fitted with a plurality of adjacent individual barrier elements along at least one of its longitudinal sides, the barrier elements extending vertically and each occupying a fraction of the length of the bed.

According to an illustrative embodiment of the present disclosure, a patient support includes a base structure including a longitudinal side, a first barrier element including a first portion, and a second barrier element including a second portion. The first and second barrier elements are positioned along the longitudinal side of the base structure. The barriers are adapted to move between raised and lowered positions. Each of the first and second barrier elements occupies a fraction of the length of the patient support. The barriers are positioned such that the first portion and the second portion overlap when both the first barrier element and second barrier element are in the raised position.

According to another illustrative embodiment of the present disclosure, a patient support includes a frame, a deck, a head end barrier element, and a foot end barrier element. The frame includes a head end, a foot end, and longitudinal sides. The deck is coupled to the frame and includes at least a head section and a seat section. The head end barrier element is positioned along at least one of the longitudinal sides of the frame near the head end. The head end barrier includes a first portion. The foot end barrier element is positioned along at least one of the longitudinal sides near the foot end. The foot end barrier element includes a second portion. The first portion and the second portion overlap allowing the foot end barrier element and the head end barrier element to extend substantially the entire length of the patient support.

According to yet another illustrative embodiment of the present disclosure, a patient support includes a frame, an articulating deck, a first siderail, and a second siderail. The frame includes a head end, a foot end, and longitudinal sides. The articulating deck is supported by the frame. The deck includes a head section and a foot section. The head section is moveable relative to the foot section. The first siderail is positioned along one of the longitudinal sides. The second siderail is positioned adjacent the first siderail. The second siderail includes a first portion positioned between the first siderail and the second siderail where the first siderail overlaps the second siderail. At least one of the first and second siderails moves with the head section during articulation of the deck.

Additional features and advantages of the invention will become apparent to those skilled in the art upon consideration of the following detailed description of illustrated embodiments exemplifying the best mode of carrying out the invention as presently perceived.

DETAILED DESCRIPTION

Figure 1:
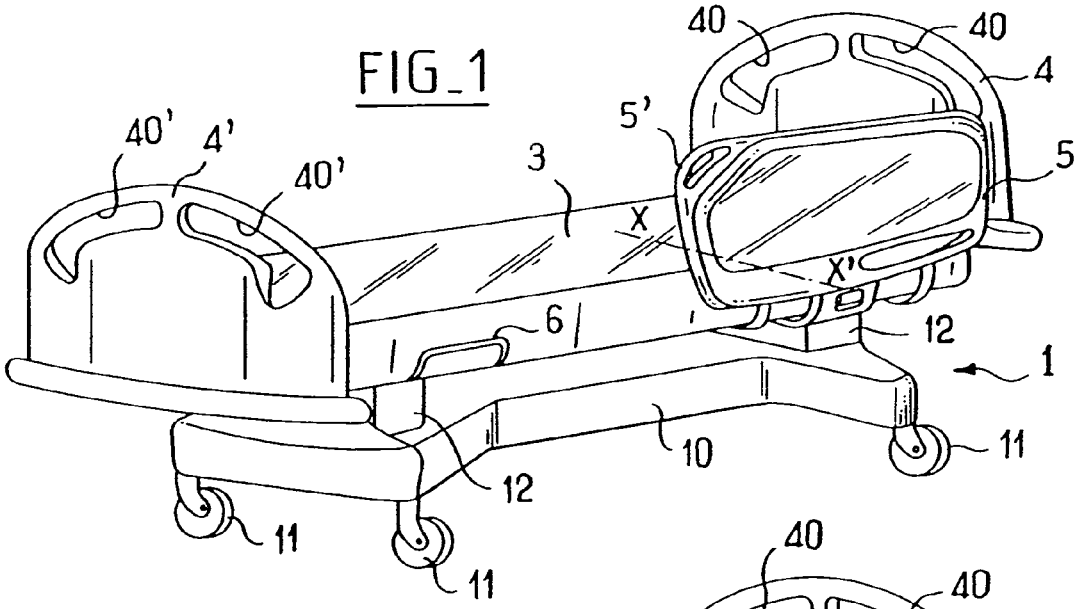
FIG. 1 is a simplified perspective view of a hospital bed in accordance with the invention, the two barrier elements being in the overlapping position, one on another and folded up above the plane of the bed.

The bed shown in accompanying FIGS. 1 to 5 has the general appearance of a hospital bed of well-known type.

It is constituted by a base structure I made up of a solid metal frame 10 having castors 11 attached thereto and defining between them an elongate rectangular shape.

The frame supports equipment 12 for raising and lowering the bed proper, mainly for the purpose of making it easier for hospital staff to take action. Such equipment is also provided for positioning the patient in so-called "safe" positions, in particular acclivous and declivous positions (sloping up and sloping down).

Naturally, the base structure can receive other mechanical and/or electronic equipment suitable for co-operating with the bed proper.

This base structure also has fixed thereto vertical panels at the head and foot ends of the bed, given respective references 4 and 4' in the figures. They extend transversely, defining the longitudinal ends of the bed.

As can be seen, these panels present large cutouts 40 and 40' which form handles and make it easier to maneuver the bed when it is desired to move it within a room or outside the room.

In conventional manner, the bed proper is essentially formed by that which is referred to throughout the present application as the "bed plane", i.e. a surface that coincides with or is situated immediately below the bottom face of the mattress and that is usually constituted by a hard plane made up of several portions, with at least one of these portions being movable so as to occupy positions other than horizontal.

This makes it possible, in particular by tilting up one or another of these portions, to put the mattress in a position similar to that of a seat.

This bed plane is not visible in FIGS. 1 to 5. These figures show only the mattress 3 which rests thereon.

Figure 2:
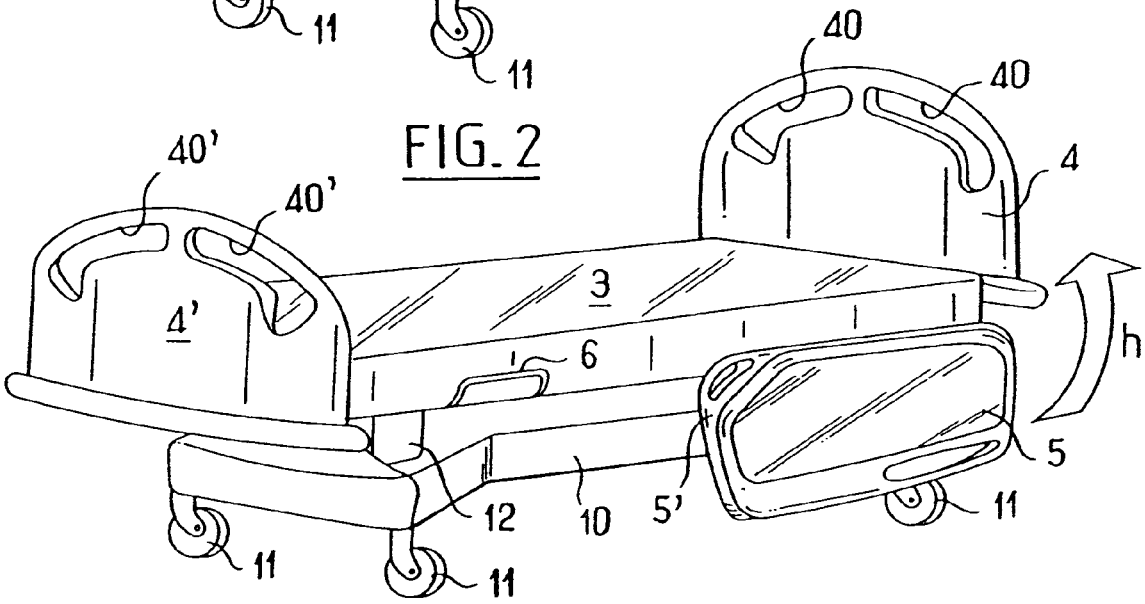
FIG. 2 is substantially analogous to FIG. 1, the two elements being retraced beneath the plane of the bed.
Figure 3:
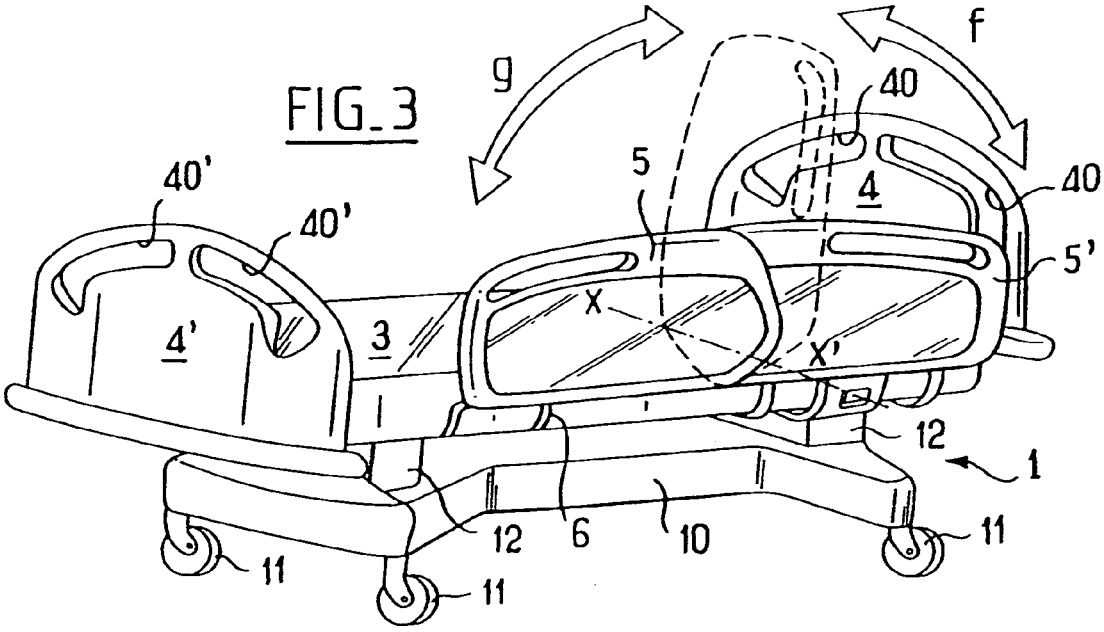
FIG. 3 shows the same bed, with one of the elements being shown both in dashed lines in a half-way tilted position and in continuous lines in a fully tilted position.
Figure 4:
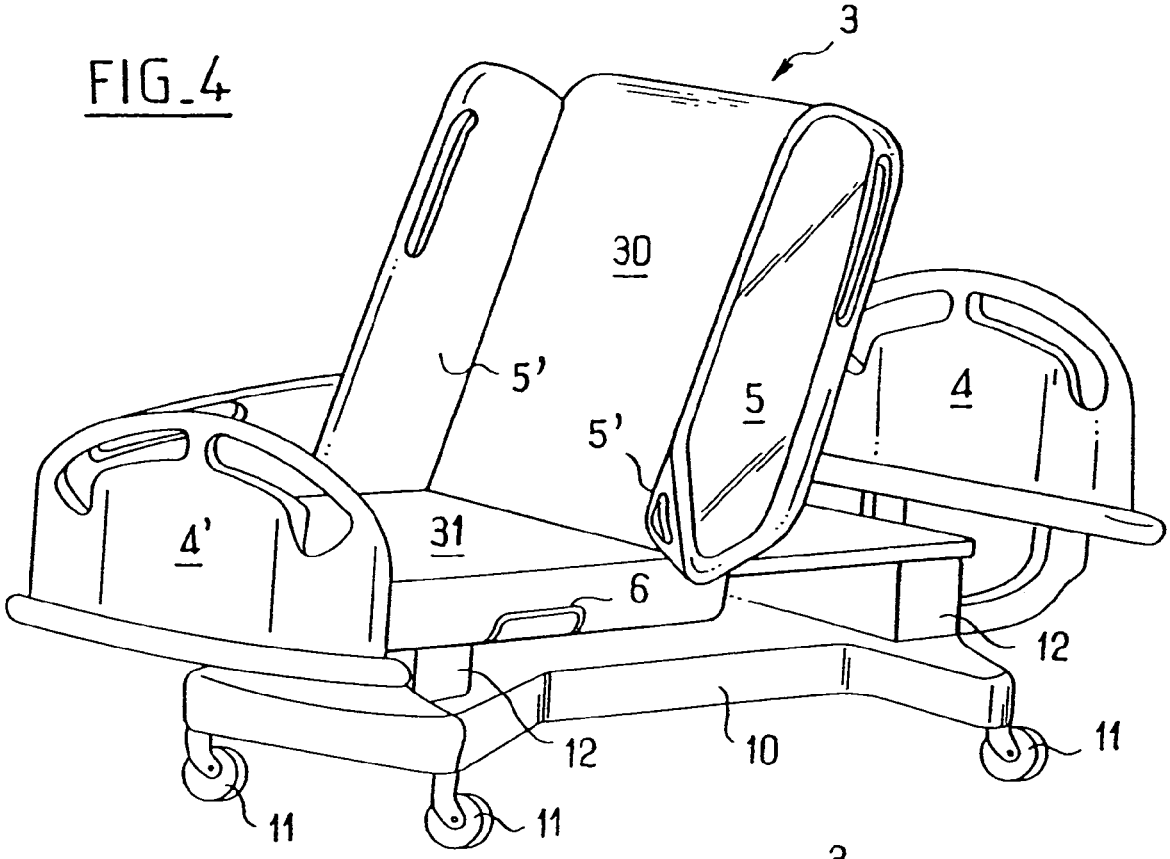
FIGS. 4 and 5 are perspective views of the bed in which the moving bed plane has been positioned so as to cause the mattress to take up a seat position; in these figures, the barrier elements are shown respectively in the overlapping position and in the deployed position.
Figure 5:
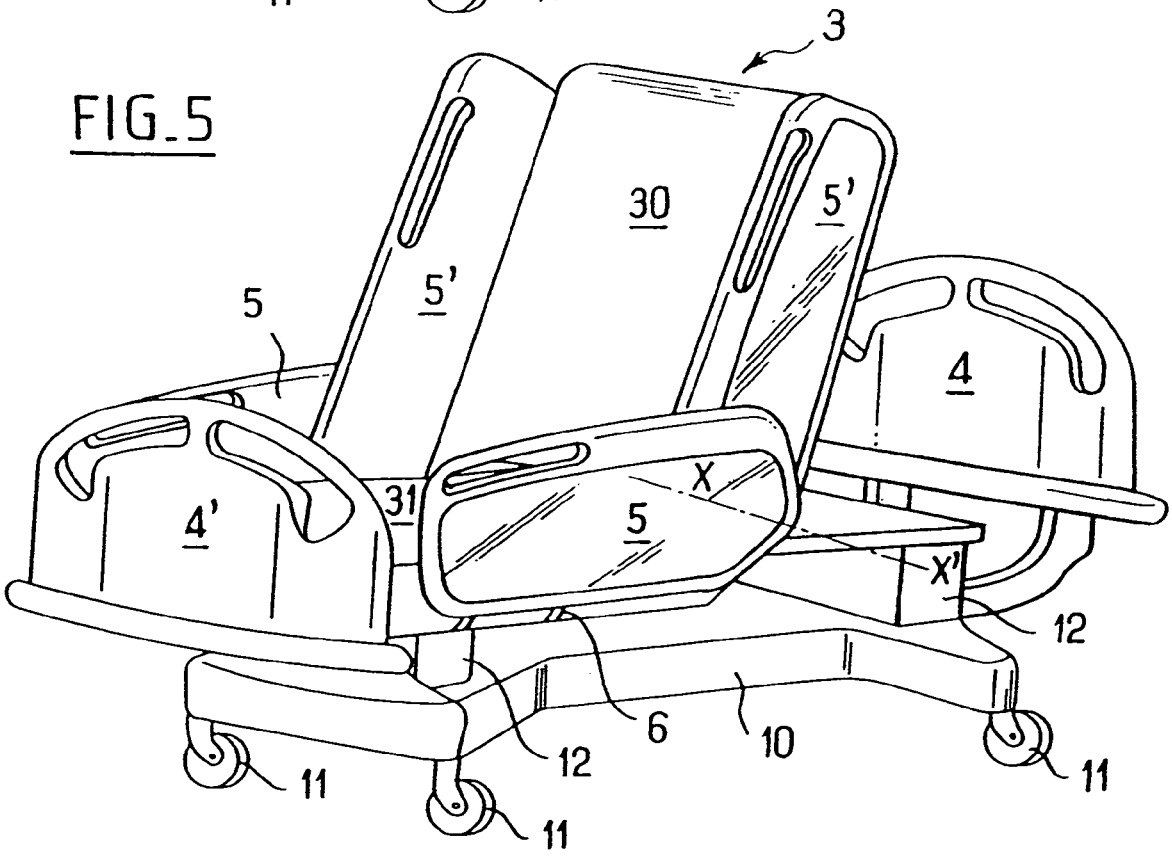

As shown in FIGS. 1 to 3, the bed is fitted in accordance with the invention with two barrier elements 5 and 5' that are hinged relative to each other. They extend parallel to one of the longitudinal edges of the bed.

These barrier elements are in the form of generally rectangular plates. Their dimensions are substantially similar, such that when they are superposed one on the other (FIGS. 1 and 2) in an "overlapping" position, they occupy much the same space as a single element.

In the longitudinal direction, they are of a size that is no greater than half the length of the mattress. In this way, when they are deployed, they occupy practically the entire length of the mattress.

In a variant embodiment, the first element could occupy substantially three-fourths of the length of the bed while the second element occupies the last fourth.

In yet another embodiment, there could be three such elements, each occupying no more than one-third of the length of the bed.

Figures 6, 7:
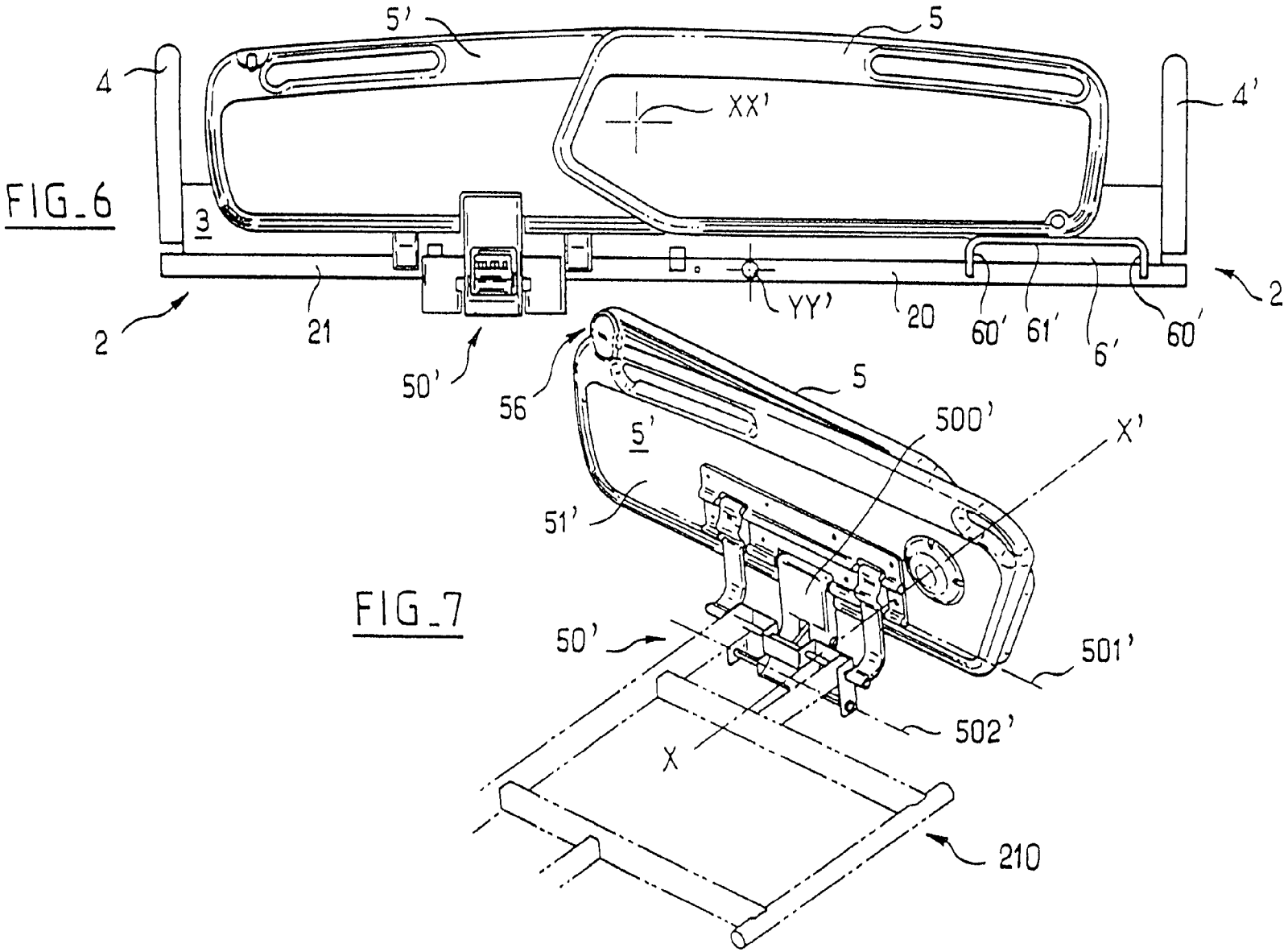
FIG. 6 is a longitudinal side view of the top portion of the bed of FIGS. 1 to 5, i.e. of the portion which includes the bed plane and all of the pieces of equipment situated above it.
FIG. 7 is a perspective view of two elements in the overlapping position, showing more particularly their face facing towards the inside of the bed and the means for fixing them to the bed plane.

FIGS. 6 and 7 show a slightly different embodiment of these two elements.

In an additional embodiment (not shown), these elements may have large open areas or glazed areas, like traditional barriers.

FIG. 6 is a side view of the bed plane 2 on which there rests the mattress 3 of the bed. This bed plane is built up by assembling bars. In the example shown, it comprises two portions 20 and 21 which are hinged relative to each other about a horizontal axis Y, Y' which is generally perpendicular to the longitudinal direction of the bed.

The portion 20 is at the foot end of the bed while the portion 21 is at its head end. When the portion 21 occupies a raised position, this enables the mattress to be put into a position similar to that of a seat.

With reference to FIG. 7, there can be seen an assembly 210 of bars constituting a fraction of the portion 21 of the bed plane.

On one of the longitudinal sides of the portion 210 there is fixed a piece of equipment 50' enabling the barrier elements 5 and 5' to be positioned either in a vertical raised position above the bed plane (FIGS. 1, 3, 6, and 7), or else in a vertical position retracted below the bed plane (FIG. 2).

This is a deformable parallelogram mechanism. It is not described in greater detail herein since, properly speaking, it does not form part of the invention.

Nevertheless, reference can be made to French patent No. 91/11185 in the name of the present Applicant which describes in particular the operation of the linkage constituting the mechanism 50'.

The mechanism makes it easy to move the barrier elements from the folded-up position of FIG. 1 to the retracted position of FIG. 2.

In FIG. 2, arrow h represents the upward movement of the barrier elements. The retracted position beneath the bed plane is particularly useful when hospital staff need to gain access to the bed without their own movements being impeded.

Naturally, the piece of equipment 50' could be replaced by some other mechanical system suitable for performing the function of retracting the elements in the overlapping position.

In accordance with the invention, the barrier elements 5 and 5' are hinged relative to each other about an axis XX' which is generally perpendicular to the longitudinal axis of the bed. This hinge is constituted by a mechanism that is not visible in FIG. 6 and comprising, for example, a cylindrical spacer, distance pieces, and a helical spring.

Nevertheless, any other known type of hinge mechanism may be adopted.

Certain embodiments of this mechanism are described below. The mechanism may merely comprise a mechanism enabling the elements to turn relative to each other without allowing them to be separated. Nevertheless, this option for separating the elements, or at least for spacing them apart from each other, is preferred so as to give access for cleaning the barrier elements in full, in particular in their zones that face each other, and still more particularly, in the zone where they overlie each other.

Figure 8:
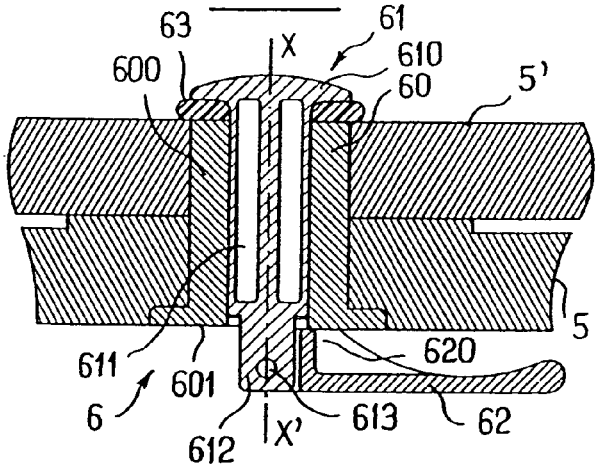
FIGS. 8 and 9 are fragmentary plan views in section on a longitudinal plane showing the barrier elements and a first embodiment of a hinge mechanism uniting them.
Figure 9:
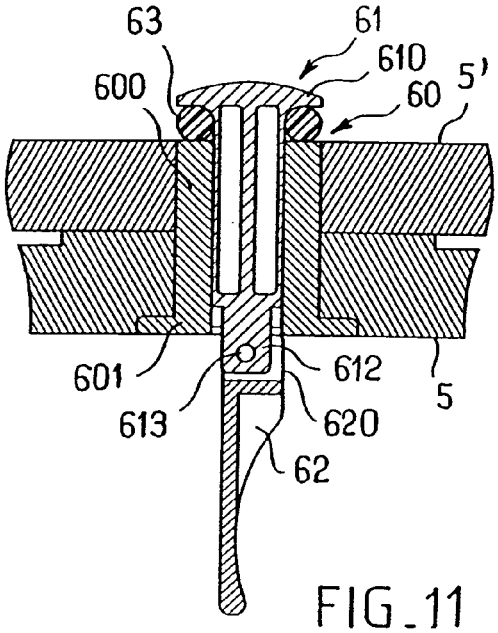

With reference to FIGS. 8 and 9, there follows a description of a first embodiment of the hinge mechanism for the barrier elements.

Each of the elements 5 and 5' presents a circular opening of the same diameter passing through its thickness, this opening receiving a bushing 60. The bushing comprises a generally cylindrical body with a generally flat peripheral flange 601 at one of its ends. The flange is received in and comes into abutment against a countersink provided in the outside face of the barrier element 5. The length of the bushing is such that the body 60 is flush with the opposite face of the element 5'.

The axis of the bushing coincides with the hinge axis XX' between the elements.

The inside space of the bushing receives a sleeve 61, and more particularly the body 611 thereof.

This body is longitudinally hollow and communicates via one of its ends with a generally flat head 610 of circular shape and of diameter greater than that of the body. Between the bushing 60 and the head 610 of the sleeve there is interposed a compressible O-ring 63, e.g. made of natural rubber.

At the opposite end of the body there is a generally longitudinal projection 612 extending beyond the thickness of the two elements.

A pivoting control handle 62 of conventional type having a cam surface 620 is hinged thereto. This hinge is about an axis 613 that is generally parallel to the planes occupied by the elements 5 and 5'.

The sleeve 61 is engaged in the bushing 60 while the handle 62 is in alignment therewith (see FIG. 9).

By folding the handle down, the sleeve is moved in translation, thereby compressing the 0-ring 63 (FIG. 8).

This configuration makes it possible to secure the elements 5 and 5' to each other while also making it possible for one of them to turn about the axis XX'.

Nevertheless, the tightness with which the handle 62 is actuated serves to brake turning of the element.

When it is desired to gain access to the facing faces of the elements 5 and 5', in particular for the purpose of cleaning them, it suffices to fold the handle out so that it is in alignment with the sleeve (FIG. 9) and to separate the element 5 by pulling on it.

Figure 10:
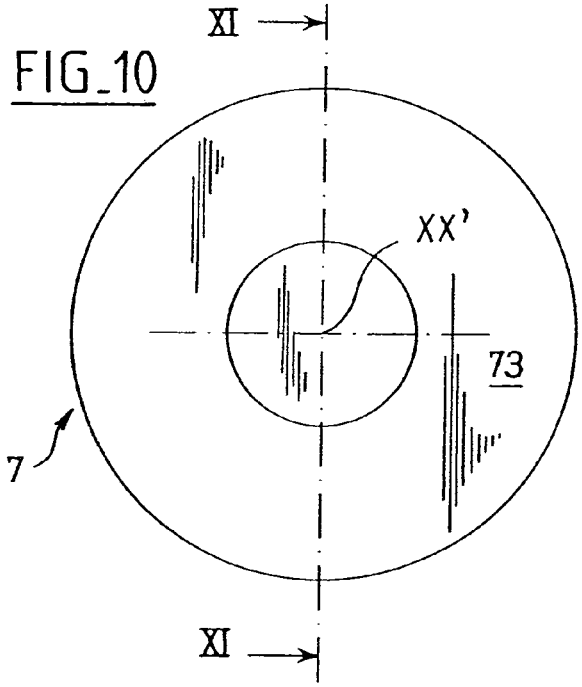
FIG. 10 is a simplified front view of another hinge mechanism.
Figure 11:
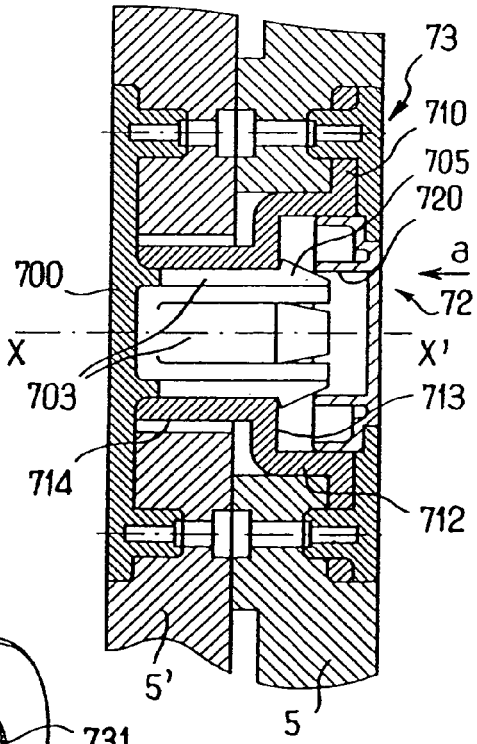
FIG. 11 is a view of the FIG. 10 mechanism in section on the plane XI—XI.
Figure 12:
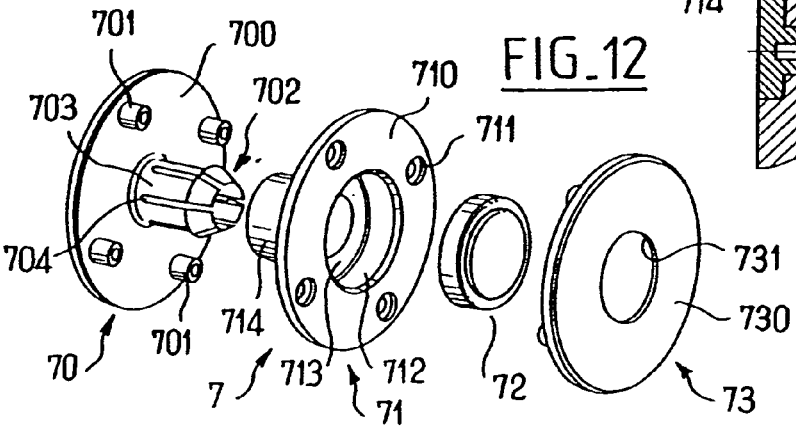
FIG. 12 is an exploded perspective view of the parts making up the hinge mechanism of FIGS. 10 to 11.
Figures 13, 14, 15, 16, 17:
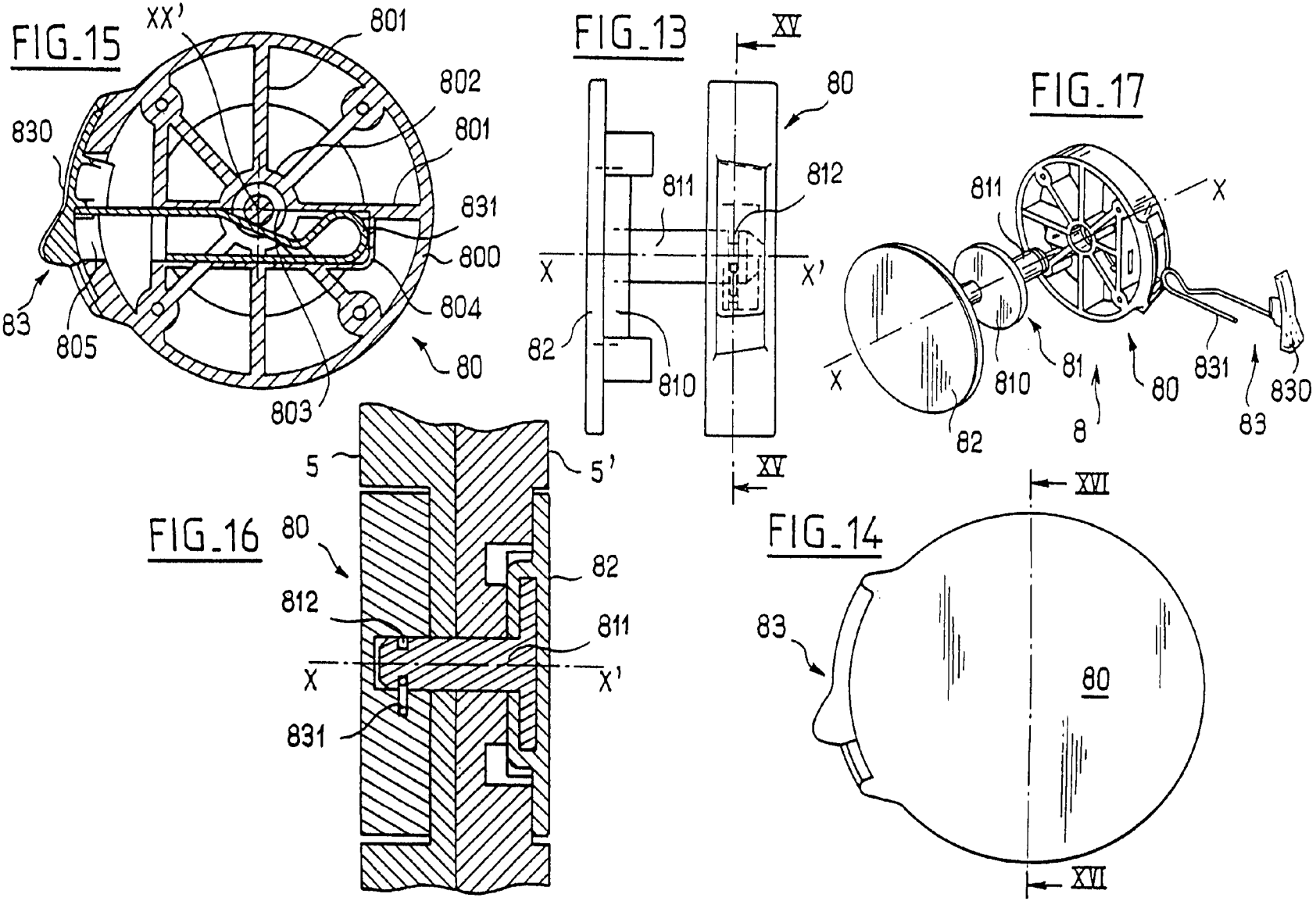
FIG. 13 is a side view of the parts making up another hinge mechanism.
FIG. 14 is a front view of the FIG. 13 mechanism.
FIGS. 15 and 16 are section views of the mechanism in the preceding figures on section planes XV, XV and XVI, XVI in FIGS. 13 and 14.
FIG. 17 is an exploded perspective view of the parts forming the mechanism.
Figures 18, 19, 20, 21, 22, 23:
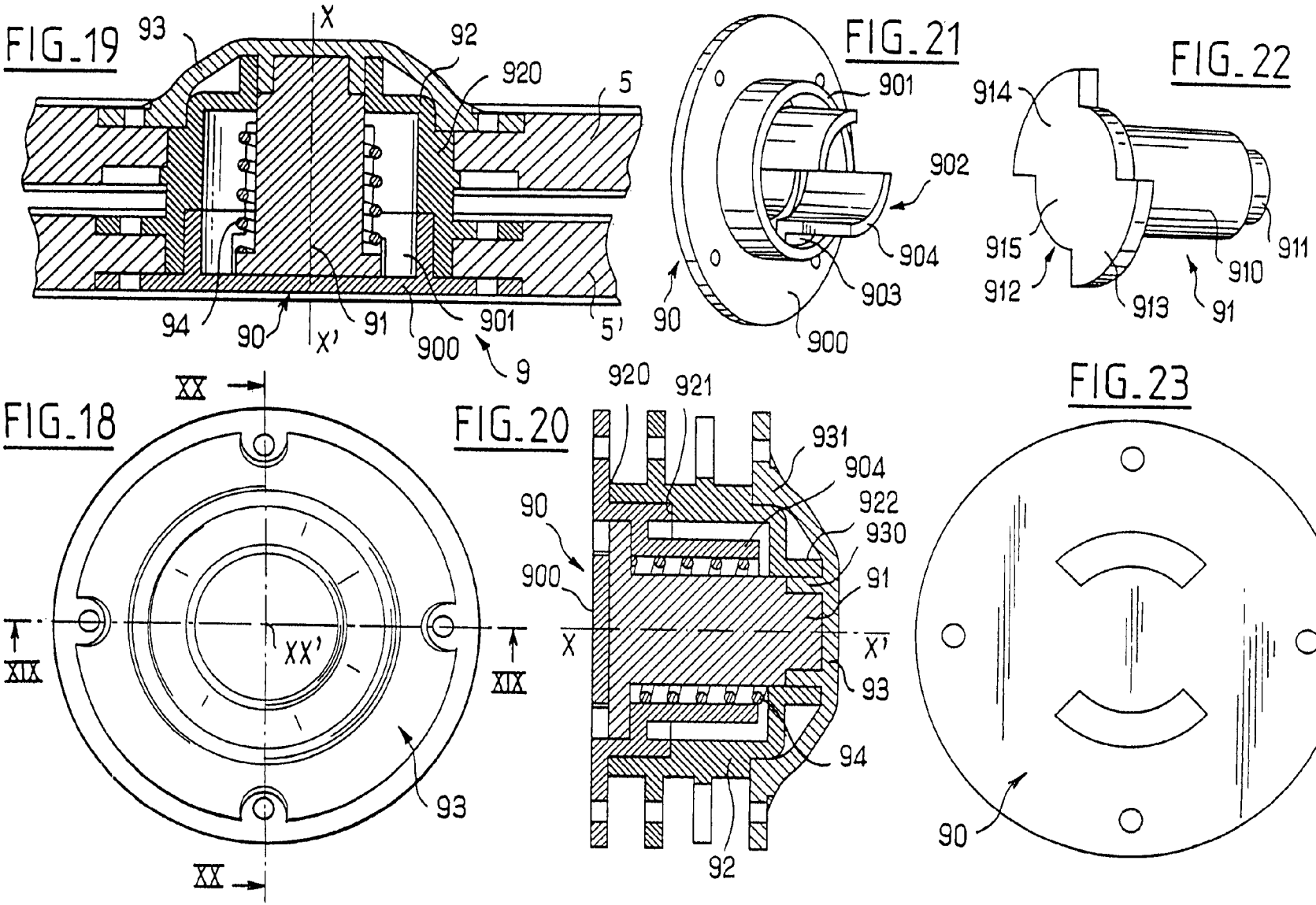
FIGS. 18, 19, and 20 are views of another embodiment of the hinge means, respectively a front view and sections on planes XIX, XIX and XX, XX of FIG. 18.
FIGS. 21, 22, and 23 are perspective views and a front view of the three parts making up this embodiment of a hinge.

Another embodiment of the hinge mechanism is described below, more particularly with reference to FIGS. 10 to 12.

In the same manner as above, each of the barrier elements presents an opening through its thickness enabling the component parts of the hinge mechanism to be inserted therein.

In this case, the hinge mechanism comprises a first part referenced 70 and referred to as the inside cap. It is for mounting beside the face of the element 5 that faces towards the inside of the bed. For this purpose, said face is locally recessed in order to receive said cap.

The cap comprises a circular plate in the form of a disk 700 whose inside face presents projecting studs 701 at the corners of a square. They are intended to receive means for fastening to the barrier elements, in particular screw fastener means.

On the same side of the plate 700 there extends from its center a generally cylindrical sleeve 702. The length of the sleeve is such that when the cap is in place on the element 5', it extends into the element 5.

This sleeve presents a set of axial slots 704 that are equidistant angularly. Between them, pairs of slots define branches 703. The cap is preferably made of a slightly deformable plastics material, such that the branches 703 are radially deformable. Their free ends form respective catches 705 with chamfered faces looking outwards.

The mechanism also comprises a spacer 71 suitable for being received in a recess provided for this purpose in the element 5. It comprises a generally cylindrical body and a plane peripheral flange 710 projecting outwards. This flange presents a series of orifices 711 for fastening the spacer to the outside face of the element 5. The body of the spacer has a first axial portion 712 which extends from the flange 710.

It communicates with another cylindrical portion of smaller diameter 714 via a shoulder-forming transition zone 713 extending parallel to the flange 710. The inside diameter of the portion 714 is equal to the outside diameter of the sleeve 702, ignoring clearance.

The central opening of the spacer 7 receives a circular button 72 having a hollow inside and which includes in particular an axially-extending partition 720 whose function is explained below.

Finally, the mechanism includes an outside cap 73 essentially constituted by a flat disk 730 with a central recess 731 for passing the button 72.

The inside cap 72 and the spacer 71 are engaged in each other from opposite sides of the elements 5 and 5'. In so doing, the portion 714 of the spacer encounters the catches 705 of the sleeve 702 so that the sleeve tends to deform radially inwards. This enables the portion 714 to come into position against the plate 700 of the spacer. This is the position shown in FIG. 11. The spacer is prevented from being withdrawn by the shoulders of the catches 705. Nevertheless, it will be understood that by pressing against the button 72 in the direction of arrow a, its partition 720 comes to bear against the catches 705, and more particularly against their chamfered flats. This causes the branches 703 to move radially by titling inwards. This enables the spacer 71 to be released and thus also the element 5 which is associated therewith.

This type of hinge mechanism, like the above-described mechanism, makes it possible to pivot the elements relative to each other. Merely by pressing on the button, it also makes it possible to separate them from each other, in particular for cleaning purposes.

FIGS. 13 to 17 show another embodiment of the hinge mechanism between the two barrier elements.

This mechanism comprises in particular an outside cap secured to the element 5 and given numerical reference 80. This cap is received in a countersink provided in the thickness of the element. It is constituted by a generally cylindrical piece of molded plastics material having an outer circular wall 800 of small thickness.

This wall has radial partitions attached thereto, there being seven such partitions referenced 801. These branches converge towards the center of the part and they join a central ring 802 of small diameter which defines an inside space 803. An opening 805 is provided in the thickness of the wall 800, giving access to a housing 804 which extends diametrically and which crosses part of the inside space 803 of the central ring 802.

The mechanism further comprises a pin 81 having a head 810 in the form of a disk and an axial rod 811. Close to its free end, the rod has a peripheral groove 812. It is positioned in such a manner that when the pin is engaged on the element 5', the groove lies inside the above-mentioned housing 804.

A cap 82 covers the pin 81 and occupies a position that is flush with the element 5'.

The outside cap 80 is suitable for receiving a blocking element 83 via the opening 805, which blocking element is constituted by a curved resilient clip 831 analogous to a hair pin, with one end having a head 830 for grasping.

When the blocking element is engaged in the opening, a zone of the clip 831 is received inside the groove 812 of the pin 81 so as to prevent it being withdrawn from the outside cap. This is the position shown in FIGS. 15 and 16. Thus, when the spring clip is in position, the elements 5 and 5' can pivot relative to each other. When the clip is extracted by pulling on its head 830, it becomes possible to disengage the pin 81 and to separate the elements 5 and 5'.

In the embodiment of FIGS. 18 to 23, the hinge mechanism comprises an outside cap 90 mounted on the element 5'. It comprises a plate 900 of circular outline with four screw-fastening orifices. This plate has a low cylindrical wall 901 in a centered position.

Two tabs extend from the wall so as to face each other, i.e. they are diametrically opposite. They are attached to the wall, substantially halfway up it.

The tabs are L-shaped, each having a base limb 903 connected to the wall and extending parallel to the plate 900. The axially-extending limb 902 of each L-shape projects in the same direction as the wall and is of a curved shape, which means that these two limbs occupy a cylinder centered on the axis of the part.

A part referred to as an "angular sector" 91 is engaged in the cap.

This part comprises a cylindrical body 910 of diameter corresponding to the inside diameter of the geometrical cylinder defined by the two limbs 902, ignoring clearance.

One end of this body carries a coaxial head 911 in the form of a cylinder of smaller diameter.

The opposite end of the body is connected to a flat plate 912 which extends in a diametral direction. The central portion 915 of the plate is circular, and it carries lugs 913 and 914 in the form of sectors of a ring. Overall this gives the plate a shape that is reminiscent of a bow tie.

The angular sector is engaged in the cap 901 via the space left empty between the limbs 902 until the plate 901 comes into contact with the plate 900.

It is then possible to turn the angular sector with the plate 912 being guided and held axially by the tabs 902.

A helical spring 94 is received in the gap between the spacer 910 and the tabs 902.

The assembly is covered by a spacer 92 in the form of a cylindrical sleeve which is fixed to the element 5'.

Its base 920 bears against the plate 900. At this level, its inside diameter is selected to be equal to the outside diameter of the wall 901, ignoring clearance.

The spacer 92 has an inside shoulder 921 which comes into abutment against the top of said wall.

Finally, its end remote from the base 920 is shaped like a cylindrical chimney 922 providing guidance in rotation for the sector 91. The spring 94 bears against the spacer, immediately behind the chimney.

The last part of this assembly is constituted by an inside cap 93. It is provided with a low cylindrical wall which is received in the chimney 922 and which constitutes an abutment in sliding for the sector 91. It is also provided with a peripheral flange 931 which presses against the spacer.

As constituted in this way, the mechanism serves to hinge the two barrier elements around the part 91. This part is constantly held inside the cap 90 under the effect of the spring 94.

Nevertheless, by causing the elements to pivot in such a manner that the lugs 913 and 914 are no longer in register with the tabs 902, it becomes possible by applying traction to the element 5' to overcome the force of the spring 94 and to move the element 5' temporarily away from the element 5. This gives access to the gap between them in order to clean them locally.

The hinge means are preferably selected in such a manner as to leave as little space as possible between the two elements in normal operation so as to ensure that even a child cannot slide a finger between them. This makes it possible to avoid any risk of a pinching accident, particularly when moving the elements.

FIGS. 24 to 27 show a system that makes it possible when the barrier elements are in the overlapping position, whether above or below the bed plane, to avoid any involuntary movement that might bring them into a position other than the desired position.

This system is shown in simplified form in the above-mentioned figures.

In these figures, reference 500' designates the main, central arm that forms an integral portion of the above-mentioned deformable parallelogram system 50'.

The barrier element 5' is hinged to the top of this arm about an axis 501', while the arm itself is hinged relative to the base structure of the bed about a parallel axis 502'.

Reference 211 designates a part that is secured to the base structure of the bed, which part comprises in two distinct zones respective openings 212 and 213 associated with respective abutments 214 and 215.

The central arm 500' is hollow and a safety catch 503' can slide in its end. This safety catch is connected to a cable 504' represented in FIGS. 25 and 27 by dashed lines.

A remote control mechanism (not shown) enables the cable to be pulled to actuate the safety catch.

Figure 24:
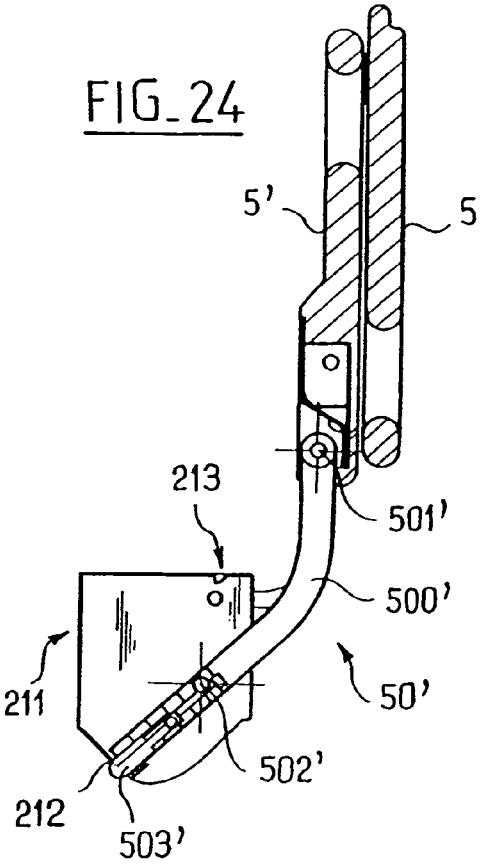
FIGS. 24 and 26 are general views of means enabling the barrier elements to be locked and unlocked when they overlap each other, respectively in the folded-up position and in the retracted position beneath the plane of the bed.

In the position of FIG. 24, the elements extend above the hard plane of the bed and the safety catch is engaged in the opening 212 of the part 211. In order to unlock the elements while in this position, it is necessary to act on the cable 504 to extract the safety catch from its housing.

When in the retracted position beneath the hard plane of the bed, the safety catch is received in the opening 213, and in that case also it is necessary to act on the cable 504' in order to change position.

Figure 25:
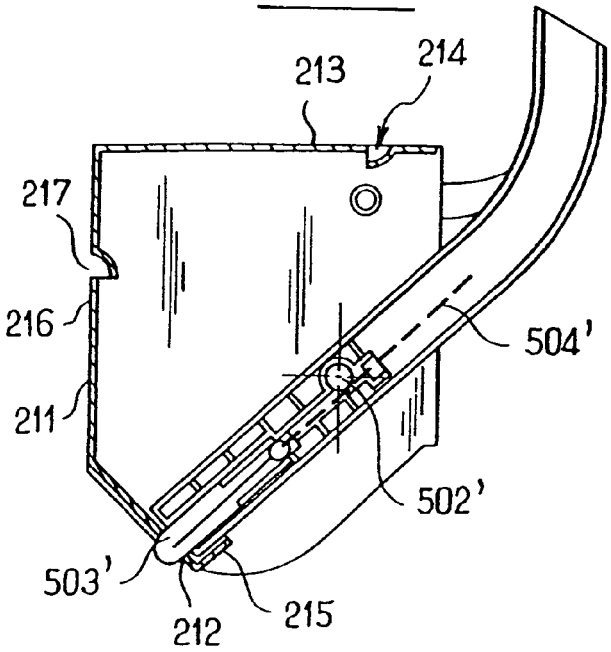
FIGS. 25 and 27 are detail views of said means.
Figure 26:
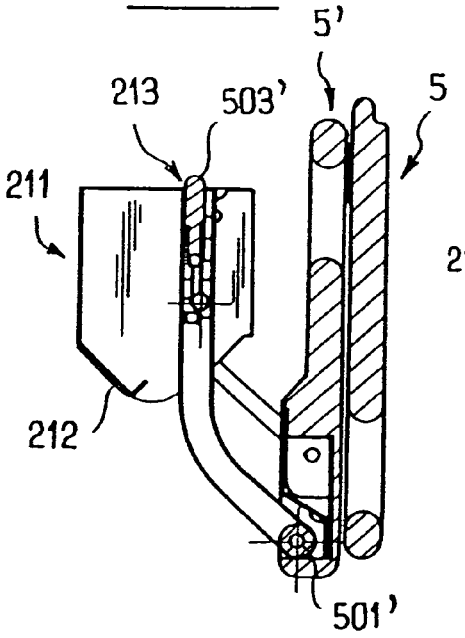
Figure 27:
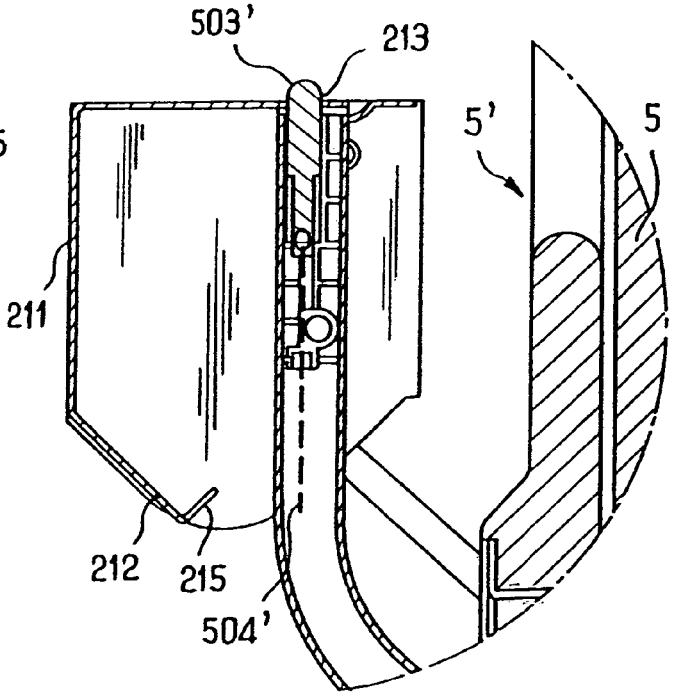

FIG. 25 shows an additional opening 216 and an additional abutment 217 on the part 211. They enable the elements 5 and 5' to occupy an intermediate locked position between the positions described above. More precisely, this is a position in which the elements are spaced apart from the bed and extend in part above the bed plane. This position is particularly suited for enabling the patient to take hold of a handle situated beside the axis XX' and to pull on the handle in order to get out of bed.

Figure 28:
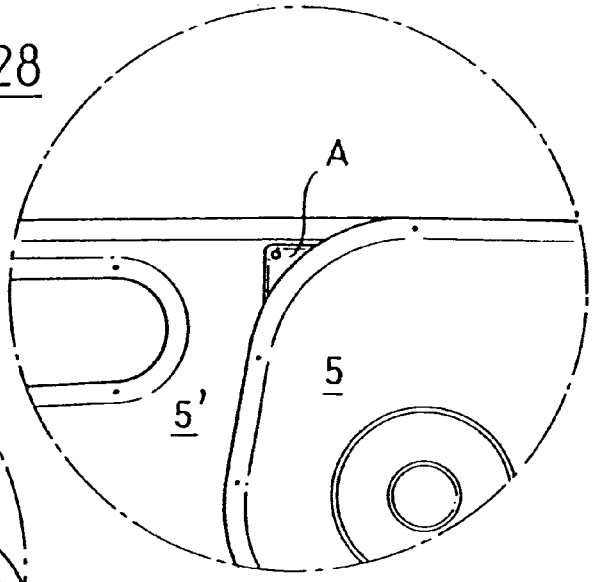
FIGS. 28 and 29 are fragmentary front views of barrier elements in the deployed position and in the overlapping position, showing more particularly means for actuating the locking and unlocking means.
Figure 29:
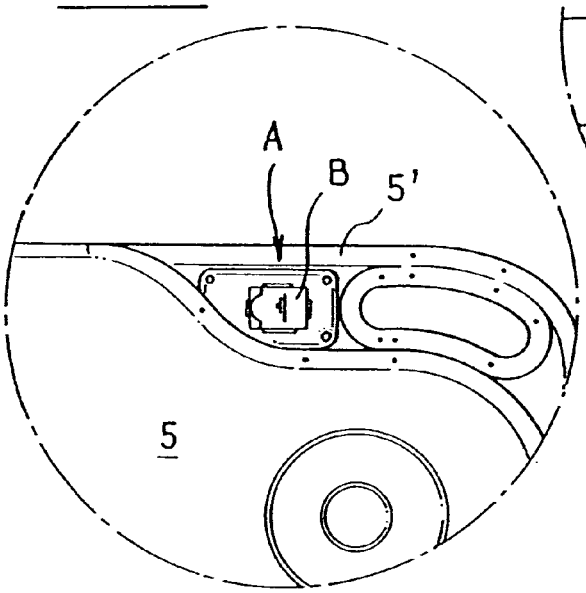

FIGS. 28 and 29 show the actuator means that enable traction to be applied to the cable 504. These means comprise a control constituted by a button B that is movable in a slideway A fixed to the element 5'. The button receives the end of the cable 504' which actuates the mechanism for retracting the barrier.

The control is positioned in such a manner that it is not directly accessible for the patient, since it faces outwards. In addition, it is positioned in such a manner that the button B is accessible only when the elements are in the overlapping position, as shown in FIG. 29.

FIG. 7 shows a mechanism 56 which is described below and which makes it possible to unite the two barrier elements when they are in the mutually overlapping position.

In this position, and as can be seen in FIGS. 1, 2, and 7, the barrier elements are contiguous with each other, and they occupy substantially the same amount of space as a single element.

This position is particularly preferred when the patient desires to avoid any danger of falling, while still being able to sit on the edge of the bed. Indeed sitting on the edge of the bed is made easier by the patient taking hold of the barrier elements.

Figure 30:
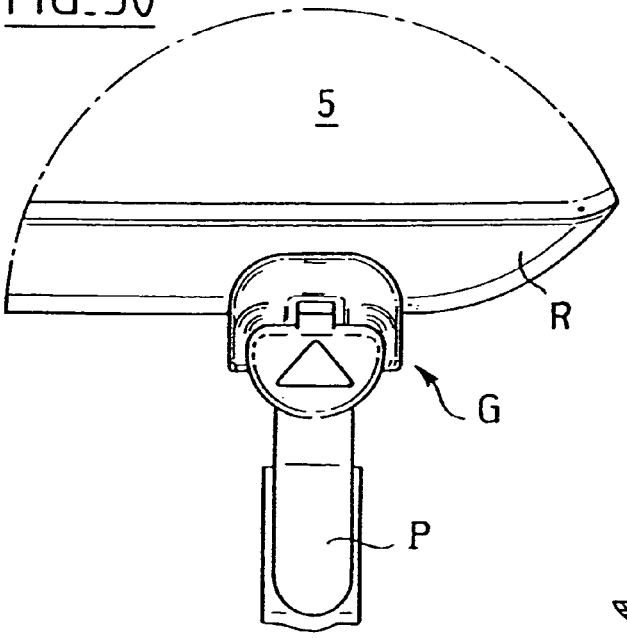
FIGS. 30 and 31 are fragmentary views, respectively a front view and a cross-section view of means for guiding the pivoting barrier element as it moves along the bed.
Figure 31:
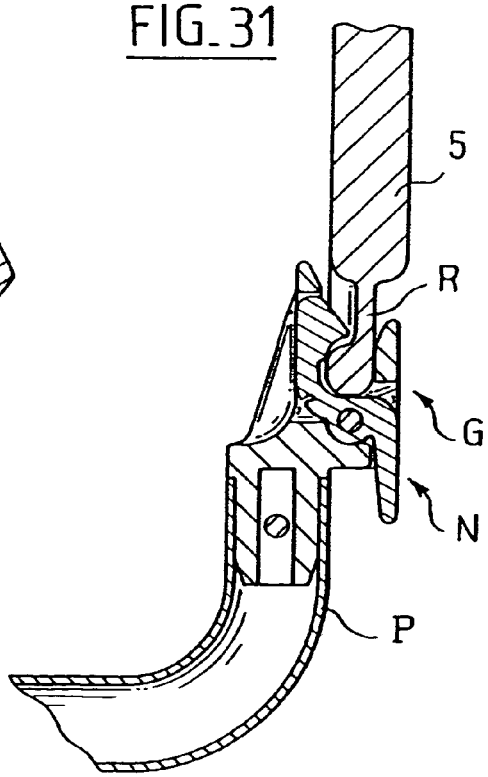

In the embodiment shown in the accompanying figures, except in FIGS. 30 and 31, the bed plane 2 is fitted longitudinally with a rail 6' for co-operating with one of the barrier elements. It is situated longitudinally on the side of the bed, on the portion 20 of the bed plane opposite from the portion carrying the retraction equipment 50'.

This rail is constituted by an upside-down U-shaped meal bar whose two parallel vertical limbs 60' are joined to the bed plane by a respective horizontal end portions that are not visible.

The bar 61' uniting them thus extends longitudinally and horizontally along the bed plane.

Figure 32:
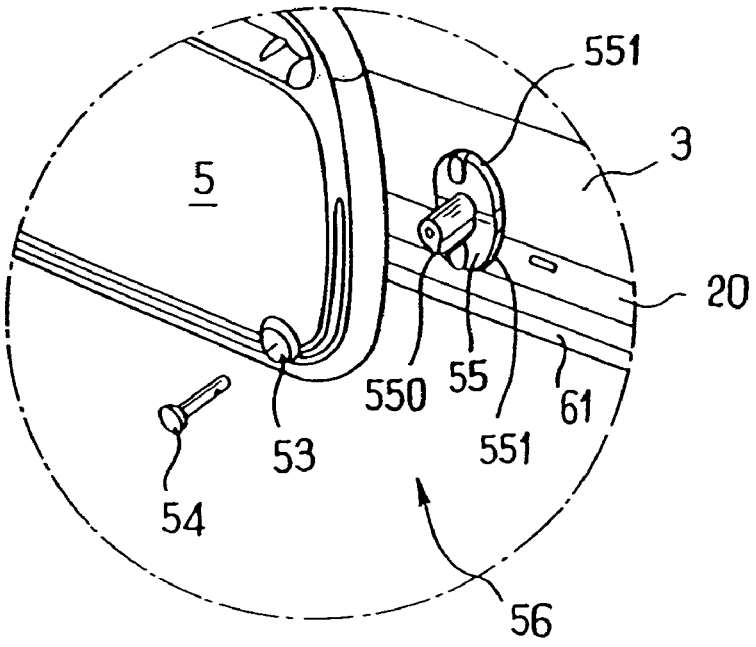
FIGS. 32 and 33 are fragmentary views respectively a front view and a perspective view of one of the barrier elements and of additional means enabling it to co-operate in sliding with a rail provided on the plane of the bed.
Figure 33:
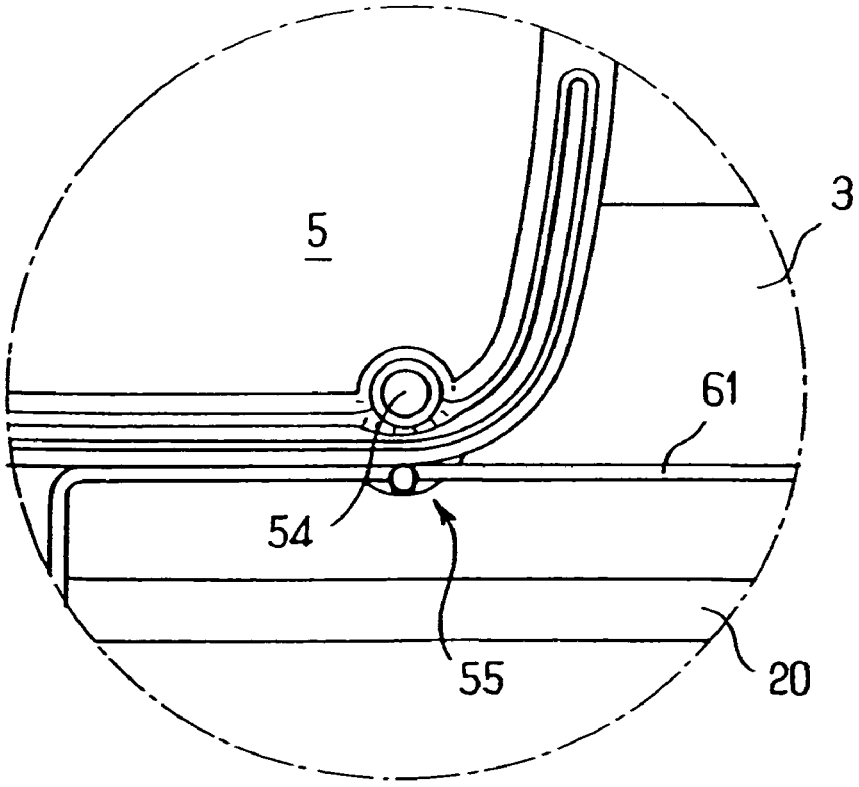

The mechanism 56 for locking together the two barrier elements can be seen more particularly in FIG. 32. It comprises an orifice 53 passing through the thickness of the element 5 and receiving from the outside of the bed a button 54. This button has a rod which passes through the thickness of the element 5 and comes out the opposite side.

At this level, the rod receives a catch 55 which is generally T-shaped. The upright of the T-shape co-operates with the rod of the button, while its two perpendicular cross-bar portions 551 are disposed vertically on the side of the element 5. Each cross-bar portion co-operates with the associated element 5 to leave an empty jamming space.

When the two barrier elements are overlapping one on the other (FIG. 7) it is possible to lock them together by bringing the catch 55 so that one of its cross-bar portions 551 pinches the top edge of the element 5'.

When the two elements are in the deployed position, i.e. when they occupy a parallel position substantially in line with each other (FIGS. 3 and 6), it is the opposite cross-bar portion of the T-shape which co-operates with the base 60' of the guide rail 6'.

The rail performs a first function which is an abutment function in which it prevents the barrier element 5 from pivoting below the level of the bed plane.

Nevertheless, it also performs a second function which is to guide the element 5'.

Thus, when the head portion 21 of the bed plane is raised (FIGS. 4 and 5), it moves the set of elements 5 and 5' longitudinally towards the foot of the bed. As a result, when the two elements are in the deployed position (FIG. 5), the rail 6 serves not only to press against the element 5, but also to guide it longitudinally as a function of the position of the bed plane. Furthermore, when the bed plane is returned to the strictly horizontal position, the barrier element 5 can be seen to move along the rail 6'.

It should be observed that the operation of tilting the barrier elements to go from one position to the other is very easy to perform since it suffices to take hold of the outer element 5 and cause it to pivot about the axis XX'. The double-headed arrows in FIG. 3 illustrate these movements. In addition, large handle-forming notches are provided in this case in the thickness of the elements, in order to make these operations even easier.

In the embodiment of FIGS. 30 and 31, the bottom portion of the element 5 comprises a longitudinally extending element of smaller thickness referenced R. The base structure of the bed includes a stand P projecting towards the outside of the bed so as to be situated vertically beneath the element 5. Its top portion constitutes a slideway G in which a handle N is hinged.

The shape of the portion R of the element 5 is complementary to that of the slideway.

When the element 5 is deployed, the portion R clips automatically into the slideway and in order to release the element it is pulled upwards while actuating the handle N.

Thus, in operation, when the various portions of the bed are moving, the element 5 implements longitudinal displacement by the portion R sliding in the slideway.

Figure 34:
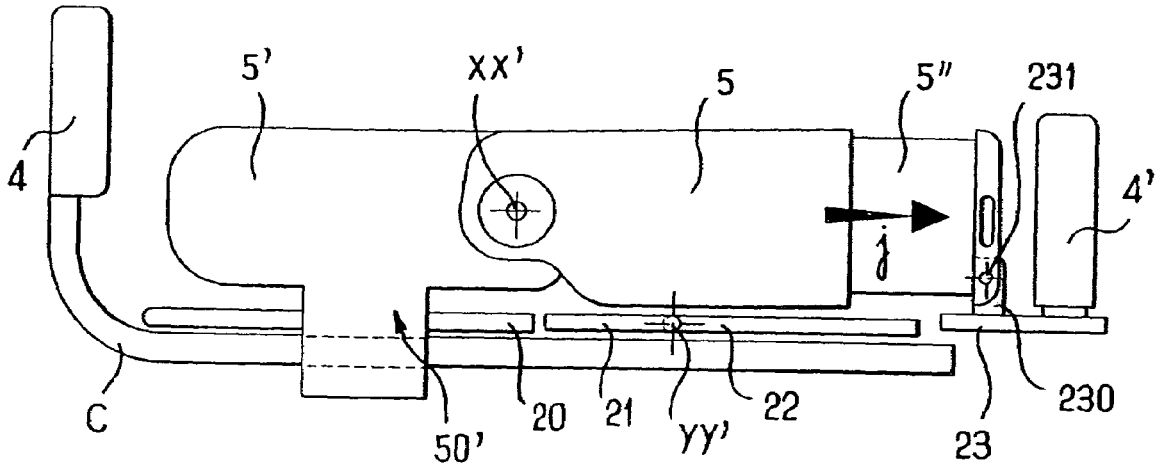
FIG. 34 is a simplified longitudinal side view of the top portion of an additional embodiment having three barrier elements, one of which is slidable.
Figure 35:
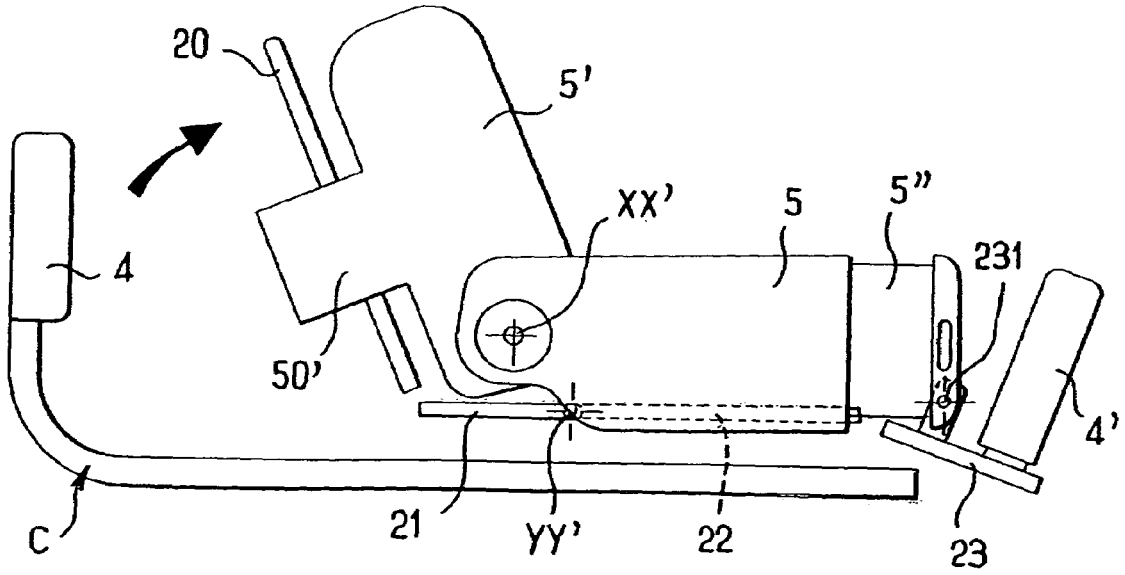
FIG. 35 is a view analogous to that of FIG. 34, with the "bed head" portion being raised, while the "bed foot" portion is lowered.

The bed shown in part in FIGS. 34 and 35 has a frame C fitted at one of its ends with a bed head panel 4. At the opposite end, a bed foot panel 4' is secured to an assembly suitable for supporting the legs of a patient in different orientations.

The frame C receives the hard bed plane which is constituted in this case by four distinct elements 20, 21, 22, and 23. The element 20 is secured to a torso-lifting mechanism capable of occupying various horizontal positions (see FIG. 35). The element 21 is stationary while the element 22 is hinged thereto about an axis YY' that is generally horizontal and extends transversely relative to the longitudinal axis of the bed. Thus, it can occupy positions that are not horizontal. Finally, a last element 23 is secured to the above-mentioned leg-raising assembly.

A bed head barrier element 5' is hinged to the bed plane element 20. This element is secured to a retraction mechanism 50' of the same type as that described above.

As in the examples described above, a barrier element 5 is hinged to the element 5' about an axis XX' that is generally perpendicular to the longitudinal axis of the bed.

The element 5 is hollow and an additional barrier element 5" is received inside it. By pulling on this additional element in the direction of arrow i (FIG. 34), this element is caused to rest on a locking device 230 fitted to the element 23 of the bed plane. This device is preferably fitted with a pivot and support pin 231 such that regardless of the respective orientations of the elements 20 to 23, the barrier element 5" might possibly slide, but always while being supported on the device 230.

In addition, the element 23 may be provided with an integral extension (not shown) e.g. having a length of 18 centimeters (cm).

The element 5" can then slide simultaneously with the element 23 being extended, thus adapting it to the length of the bed. This makes it possible to provide the patient with continuous protection, regardless of the orientations of the portions 20, 22, and 23.

By means of this system combining hinged and sliding barrier elements, it is possible to provide protection beside substantially the entire length of the bed, which is particularly reassuring both for the patient and for hospital staff.

When the barrier elements are in the erect position, a space is released beneath the bed plane going from the element 5' to the locking mechanism 230, and this occurs regardless of the position of the bed and of its barrier elements.

Figure 36:
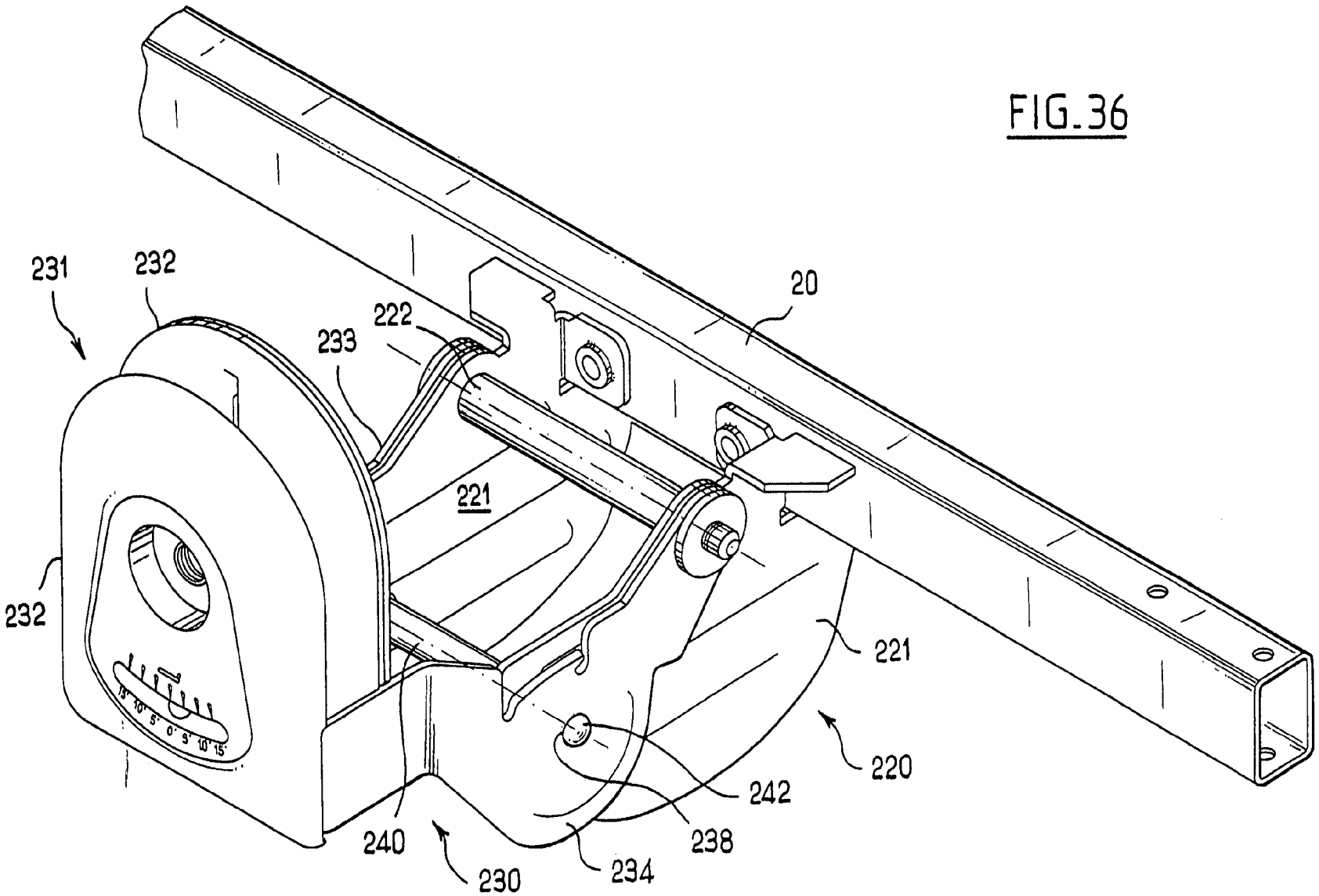
FIG. 36 is a perspective view of an additional embodiment of a retractable support part for one of the pivoting barrier elements, said part being shown in its raised position.
Figure 37:
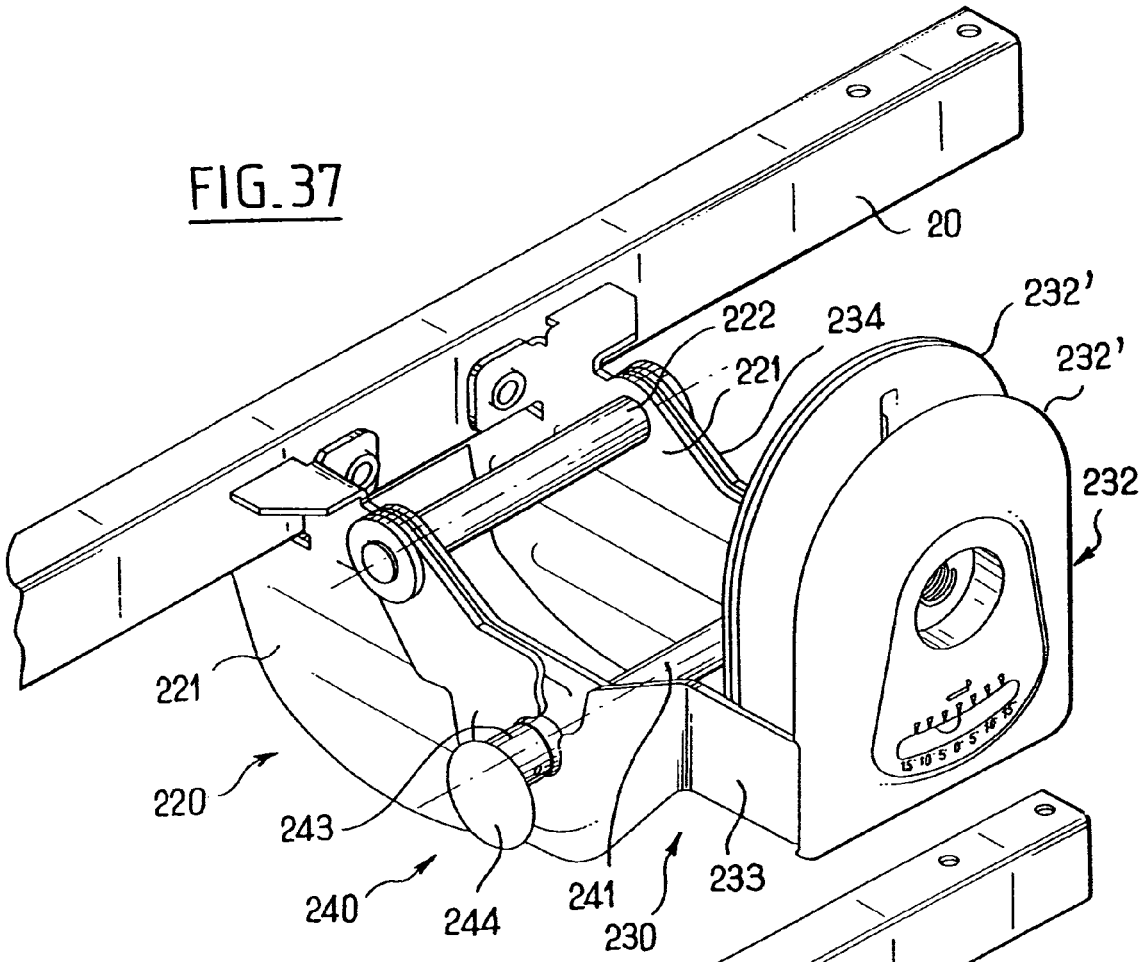
FIG. 37 is a view of the same part, seen in another direction.
Figure 38:
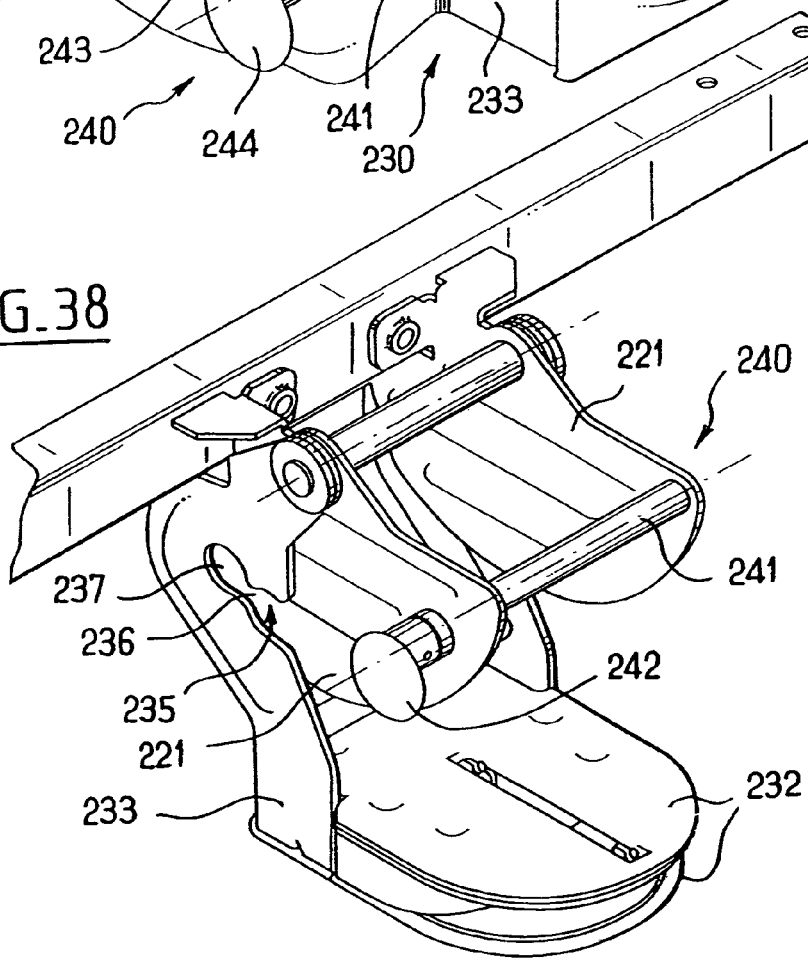
FIG. 38 is also a view of the same part, but in the retracted position.

FIGS. 36 to 38 show a retractable support part for the element 5, constituting a variant embodiment of the above-described foot P.

This part is situated along one of the bars 20 and projects transversely relative to the bed. It is constituted by a pair 220 of stationary lugs 221 and by a flap-forming element 230.

The lugs 221 extend parallel to each other transversely and vertically relative to the bar 20. On top and close to the bar 20, they carry a pin 222 parallel to the longitudinal axis of the bed. Further down and away from said bar, each of them is pierced by an opening for passing a locking pin 240.

This pin is constituted by a cylindrical rod 241 and by an actuator button 244. They are separated by a cylindrical sleeve 243 which is integral with the button and of a diameter that is greater than that of the rod 241. This rod extends between the lugs, while the button 244 and the sleeve 243 lie outside the zone between them. Finally, the free outside end of the rod 241 is terminated by a tip 242 of small diameter which passes through the corresponding lug opening provided for this purpose.

The rod 241 has a helical spring secured thereto (not shown) tending to urge said rod into the position shown in the figures, i.e. with the cylindrical sleeve 243 pressing against the first lug and the tip 242 engaged in the opening in the second lug.

A flap-forming element 230 is hinged to the lugs. This element comprises two parallel branches 233 and 234 interconnected by a solid part 232 having two parallel partitions 232'.

The branches are hinged to the lugs about the pin 222. They are spaced apart slightly wider than the lugs.

The branch 233 has a notch 235 opening out upwards. The "bottom" 237 of this notch is circular and its diameter is equal to the diameter of the sleeve 243, ignoring clearance (see FIG. 37). Nevertheless, the width of the notch tapers close to its bottom so as to constitute a constriction 236 whose opposite edges are spaced apart by a distance that is smaller than the diameter of the bottom 237.

Finally, the solid part 232 interconnecting the branches 233 and 234 is constituted by two parallel plates 232' having a space left between them for receiving the bed barrier element 5.

In the position of FIGS. 36 and 37, the support part is suitable for receiving the element 5 which presses against that part 232 between the plates 232'.

Nevertheless, when the two elements overlap each other, the part 232 can hinder a patient attempting to get out of bed.

It is then useful to be able to retract the flap 230.

For this purpose, the button 244 is grasped and traction is applied. This has the effect of moving the sleeve 243 away from the bottom 237 of the notch 235, thus releasing the flap 230 since the constriction 236 is no longer held by the sleeve.

This traction also has the effect of disengaging the tip 242 from the orifice 238 in the branch 234. Consequently, the flap can tilt about the pin 222.

As soon as traction on the button 244 is released, it returns to its initial position.

In order to return the flap to the erect position, it suffices to lift it manually and to pull on the button so as to be able to lock the two branches 233 and 234 together.

The retracted position can also be useful when the bed needs to be moved out from a room. When retracted in this way, the risk of the flap striking against a wall or a door frame is reduced.

The invention claimed is:

1. A patient support comprising a base structure including a longitudinal side;

a first barrier element including a first portion, the first barrier element being coupled to the base structure; and a second barrier element including a second portion, the second barrier element being pivotably coupled to the first barrier element and configured to rotate substantially 180 degrees relative to the first barrier element about a pivot axis from a lowered position to a raised position, the first and second barrier elements positioned along the longitudinal side of the base structure and each occupying a fraction of the length of the patient support and positioned such that the first portion and the second portion overlap when both the first barrier element and second barrier element are in the raised position.

2. The patient support of claim 1, wherein the first and second barrier elements are contiguous relative to each other and occupy, transversely, substantially the same space as a single element.

3. The patient support of claim 1, wherein at least one of the first barrier element and the second barrier element is stationary and the other of the barrier elements is movable when a portion of the base structure is articulated.

4. The patient support of claim 1, wherein the first and second barrier elements include a handle positioned to assist a patient moving on the patient support.

5. A patient support comprising:

a frame including a head end, a foot end, and longitudinal sides;

a deck coupled to the frame, the deck including at least a head section and a seat section;

a head end barrier element being coupled to the frame and positioned along at least one of the longitudinal sides near the head end, the head end barrier including a first portion; and a foot end barrier element positioned along the at least one of the longitudinal sides near the foot end, the foot end barrier element including a second portion and being pivotably coupled to the head end barrier element and configured to rotate substantially 180 degrees relative to the head end barrier element about a pivot axis, wherein the first portion and the second portion are configured to overlap such that the foot end barrier element and the head end barrier element extend substantially the entire length of the patient support.

6. The patient support of claim 5, wherein the overlapping first and second portions occupy approximately the same space as one of the head end barrier element and the foot end barrier element.

7. The patient support of claim 5, wherein the head end barrier element and foot end barrier elements are each configured to move between a raised position and a lowered position.

8. The patient support of claim 5, wherein the head section is configured to move relative to the seat section.

9. The patient support of claim 8, wherein the head end barrier element moves with the head section when the head section moves relative to the seat section.

10. The patient support of claim 8, wherein the foot end barrier element remains stationary when the head section moves relative to the seat section.

11. The patient support of claim 5, wherein at least one of the head end barrier element and foot end barrier element includes a handle positioned to assist a patient moving on the patient support.

12. A patient support including:

a frame including a head end, a foot end, and longitudinal sides;

an articulating deck supported by the frame, the deck including a head section and a foot section, the head section moveable relative to the foot section;

a first siderail coupled to the frame and positioned along one of the longitudinal sides;

a second siderail pivotably coupled to and positioned adjacent the first siderail; and a portion positioned between the first siderail and the second siderail where the first siderail overlaps the second siderail, at least one of the first and second siderails moves with the head section during articulation of the deck.

13. The patient support of claim 12, wherein the first and second section siderails are moveable between raised and lowered positions.

14. The patient support of claim 12, wherein the portion includes a first siderail portion and a second siderail portion, the first and second siderail portions overlap allowing first and second siderails to maintain uniform thickness when overlapped.

15. The patient support of claim 12, wherein the head section is configured to move relative to the seat section.

16. The patient support of claim 15, wherein the first siderail moves with the head section when the head section moves relative to the seat section.

17. The patient support of claim 15, wherein the second siderail remains stationary when the head section moves relative to the seat section.

18. The patient support of claim 12, wherein the first siderail continuously overlaps the second siderail during articulation of the deck.

19. The patient support of claim 12, wherein at least one of the first siderail and second siderail includes a handle positioned to assist a patient moving on the patient support.

20. The patient support of claim 12, wherein the second siderail is configured to rotate substantially 180 degrees relative to the first siderail about a pivot axis.

21. A patient support comprising:

a base structure including, a first end, a second end spaced apart from the first end, a longitudinal side connecting the first end and the second end and a base structure axis extending longitudinally from the first end to the second end;

a first barrier element including a first portion spaced apart from the first end, a second portion spaced apart from the first portion and a first barrier portion axis extending along a longitudinal length of the first portion, the first barrier element being coupled to the base structure; and a second barrier element including a first portion spaced apart from the second end, a second portion spaced apart from the first portion, the second barrier element configured to rotate substantially 90 degrees relative to the first barrier element from a lowered position to a raised position, the first and second first barrier elements positioned along the longitudinal side of the base structure and each occupying a fraction of the length of the patient support and positioned such that the first portion of the first barrier element and the first portion of the second barrier element overlap when both the first and second barrier elements are positioned in the raised position and the first barrier portion axis is parallel to the base structure axis as the second barrier element rotates.

22. The patient support of claim 21, wherein the first and second barrier elements are contiguous relative to each other and occupy, transversely, substantially the same space as a single element.

23. The patient support of claim 21, wherein at least one of the first barrier element and the second barrier element is stationary and the other of the barrier elements is movable when a portion of the base structure is articulated.

24. The patient support of claim 21, wherein the first and second barrier elements include a handle positioned to assist a patient moving on the patient support.

* * * * *